United States Patent [19]

Gee

[11] Patent Number: 4,992,631

[45] Date of Patent: Feb. 12, 1991

[54] MULTI-DIRECTIONAL SWITCH ASSEMBLY

[75] Inventor: Cuyler Gee, San Francisco, Calif.

[73] Assignee: Atari Corporation, Sunnyvale, Calif.

[21] Appl. No.: 360,337

[22] Filed: Jun. 2, 1989

[51] Int. Cl.[5] ..... H01H 13/70; H01H 25/04

[52] U.S. Cl. ..... 200/5 A; 200/6 A; 200/339; 200/517; 200/557

[58] Field of Search ..... 200/5 R, 5 A, 6 A, 17 R, 200/18, 553, 557, 512, 517, 292, 339; 368/3, 10; 340/706; 273/148 B

[56] References Cited

U.S. PATENT DOCUMENTS

| | | | |
|---|---|---|---|
| 3,005,055 | 10/1961 | Mattke | 341/184 |
| 4,029,915 | 6/1977 | Ojima | 364/709.15 |
| 4,124,787 | 11/1978 | Aamoth et al. | 200/6 A |
| 4,246,452 | 1/1981 | Chandler | 200/5 A |
| 4,256,931 | 3/1981 | Palisek | 200/5 A |
| 4,395,134 | 7/1983 | Luce | 368/3 |
| 4,401,864 | 8/1983 | Ichikawa | 200/339 X |
| 4,408,103 | 10/1983 | Smith, III | 200/6 A |
| 4,428,649 | 1/1984 | Main et al. | 350/637 |
| 4,520,240 | 5/1985 | Swindler | 200/339 X |
| 4,687,200 | 8/1987 | Shirai | 273/148 B |

*Primary Examiner*—J. R. Scott

*Attorney, Agent, or Firm*—Michael L. Sherrard; Robert B. Chickering

[57] ABSTRACT

A multi-directional switch assembly, such as a joypad or joystick for an electronic game apparatus, including a printed circuit board, a resiliently deformable member having contact elements thereon and an input member mounted to deform the deformable member to effect closing of the switches. The input member is pivotally mounted by a post assembly, and the post assembly is supported by the game apparatus housing in a manner which is independent of the printed circuit board to substantially isolate the printed circuit board from thrust forces manually applied to the joypad input member.

12 Claims, 3 Drawing Sheets

MULTI-DIRECTIONAL SWITCH ASSEMBLY

TECHNICAL FIELD

The present invention relates, in general, to multi-directional switches of the type frequently employed in electronic or computer game apparatus, and more particularly, relates to multi-directional switch assemblies which are mounted on printed circuit boards.

BACKGROUND ART

Multi-directional switch assemblies are in widespread use in connection with electronic and computer game apparatus. So-called "joysticks" and "joypads" are commonly used as input means for control of the images on video display screens of such game apparatus. A typical joystick multi-directional switch assembly is shown in U.S. Pat. No. 4,408,103, and a similar joypad multi-directional switch assembly is shown in U.S. Pat. No. 4,687,200.

These multi-directional switches often include a plurality of contact or terminal pairs formed as part of a printed circuit board. Superimposed over the switch terminals are a plurality of electrically conductive members that are carried by a resiliently deformable member, such as a rubber or synthetic rubber diaphragm or cone assembly. Mounted to deform or displace the resilient contact-carrying member is a manually engageable movable input member, such as the joystick of U.S. Pat. No. 4,408,103 or the joypad of U.S. Pat. No. 4,687,200.

The joypad or joystick input members are mounted for tilting about a central universal or gimbal support assembly. When the pad or stick is tilted about the support assembly, an edge or arm thereof presses the deformable contact-carrying member down until the contacts span across the switch terminals on the printed circuit board to close the switch. Arrangement of the switch to have four mutually perpendicular arms allows such multi-directional switch assemblies to control movement of video screen images in a direction which corresponds to the direction of displacement of the joystick or joypad. Thus, a user-friendly interface or input means for control of image motion is provided by such multi-directional switch assemblies.

A common objective in the design of electronic game apparatus, and particularly hand-held electronic game apparatus, is to minimize the overall volume of the game unit. Economies of space, therefore, are pursued wherever possible in connection with electronic games. The result is that multi-directional joystick or joypad assemblies normally are mounted directly on printed circuit boards. The printed circuit board has the switch terminals integrated in an upper surface thereof, and the deformable rubber member which carries the switch closing contacts similarly is mounted on the printed circuit board, as is the pivotal support assembly for the joypad or joystick.

The play of computer games, which require intricate and rapid image manipulation, can result, however, in considerable stress or shock loading of the game apparatus through the rapid and sometimes forceful use of the joystick or joypad. As the tension and speed of the game increase, the player is likely to press harder and faster on the joypad or joystick. Additionally, such rapid and intricate image control requires a high degree of responsiveness of the control switching to joystick displacement. Joysticks and joypads are, therefore, preferably mounted by support assemblies having a minimum of play or slack which can reduce the responsiveness of the image to the joystick displacement. Thus, support of the joystick or joypad by a support mechanism that is relatively free of play and can effectively withstand shock loading and fatigue without transferring the loading forces to the somewhat fragile electronic circuitry is an important requirement of electronic game apparatus joystick assemblies.

One mounting structure which has been found to be particularly well suited for the mounting of multi-directional switch input joysticks or pads is the provision of a column or post assembly underneath the center of the stick or pad input member. The post assembly usually includes mating spherical surfaces which provide a universal joint underneath the stick or pad that is tilted. This type of joystick mount has the advantage of affording an assembly which is very responsive to stick or pad motion, while at the same time being capable of withstanding substantial thrust forces. The collar-type of joystick mount, for example as shown in U.S. Pat. No. 4,395,134, is less desirable in that it includes substantial lateral play in the stick, making the stick less responsive to user input.

Two broad types of mounting structures generally have been employed for joysticks and joypads having central support post assemblies. First, as shown in U.S. Pat. Nos. 4,687,200, 4,408,103, 4,256,931, 4,029,915 and 3,005,055, the central support structure for the joystick or joypad can be mounted directly on the switch terminal carrying substrate, usually the printed circuit board. The disadvantage of this approach is that while the joystick or pad is well supported, the thrust forces on the stick or pad are transmitted directly to the supporting printed circuit board or substrate containing the electrical circuitry for the game.

The other basic approach for central support of joysticks and joypads is for the central support column to extend through an opening in the circuitry carrying substrate to a base or frame member below the printed circuit board. Typical of such an approach are the joypad and joystick switch assemblies of U.S. Pat. Nos. 4,428,649, 4,246,452 and 4,124,787. The primary disadvantage of this approach is that as the game apparatus becomes more complex it is less and less desirable to provide apertures in the printed circuit board since they interfere with the efficiency and density of the circuit layout which could otherwise be achieved.

Accordingly, it is an object of the present invention to provide a multi-directional switch assembly having the tight responsiveness of a central supporting column and yet a column mounting structure which minimizes the transfer of thrust forces to the electronic circuitry.

Another object of the present invention is to provide a multi-directional switch assembly having an improved support structure capable of substantially isolating the electronic circuitry from thrust and shock forces normally applied to the input element of the switch assembly.

A further object of the present invention is to provide a joystick/joypad switch assembly for an electronic game or the like which has a high degree of responsiveness and improved reliability of operation.

Another object of the present invention is to provide a multi-directional switch assembly which is durable, easy to construct and is very compact.

The multi-directional switch assembly of the present invention has other objects and features of advantage which will become apparent from, or are set forth in more detail in, the accompanying drawing and following Best Mode Of Carrying Out The Invention.

DISCLOSURE OF THE INVENTION

The multi-directional switch assembly of the present invention includes a printed circuit board having a plurality of switch terminals, a resilient deformable member having a plurality of electronic conductive contact elements carried thereby and mounted proximate the printed circuit board with the contact elements superimposed and spaced from the switch terminals. A manually engageable input member is mounted proximate the deformable member and is displaceable into engagement with the deformable member to displace the same by an amount sufficient to move the contact elements into engagement with the switch terminals. The mounting means for the input member includes a central post structure having a universal support surface means to provide controlled and tight responsiveness. The improvement in the switch assembly of the present invention comprises, briefly, a supporting frame assembly coupled to the central post means which is constructed to substantially isolate and independently support the post assembly and input member with respect to the printed circuit board. In the preferred form, the post assembly is supported on a transversely extending frame member having openings therethrough to permit movement of the input member to be transmitted to the deformable member through the frame. The frame assembly extends laterally to span the subjacent printed circuit board.

BEST MODE OF CARRYING OUT THE INVENTION

Figure 1:
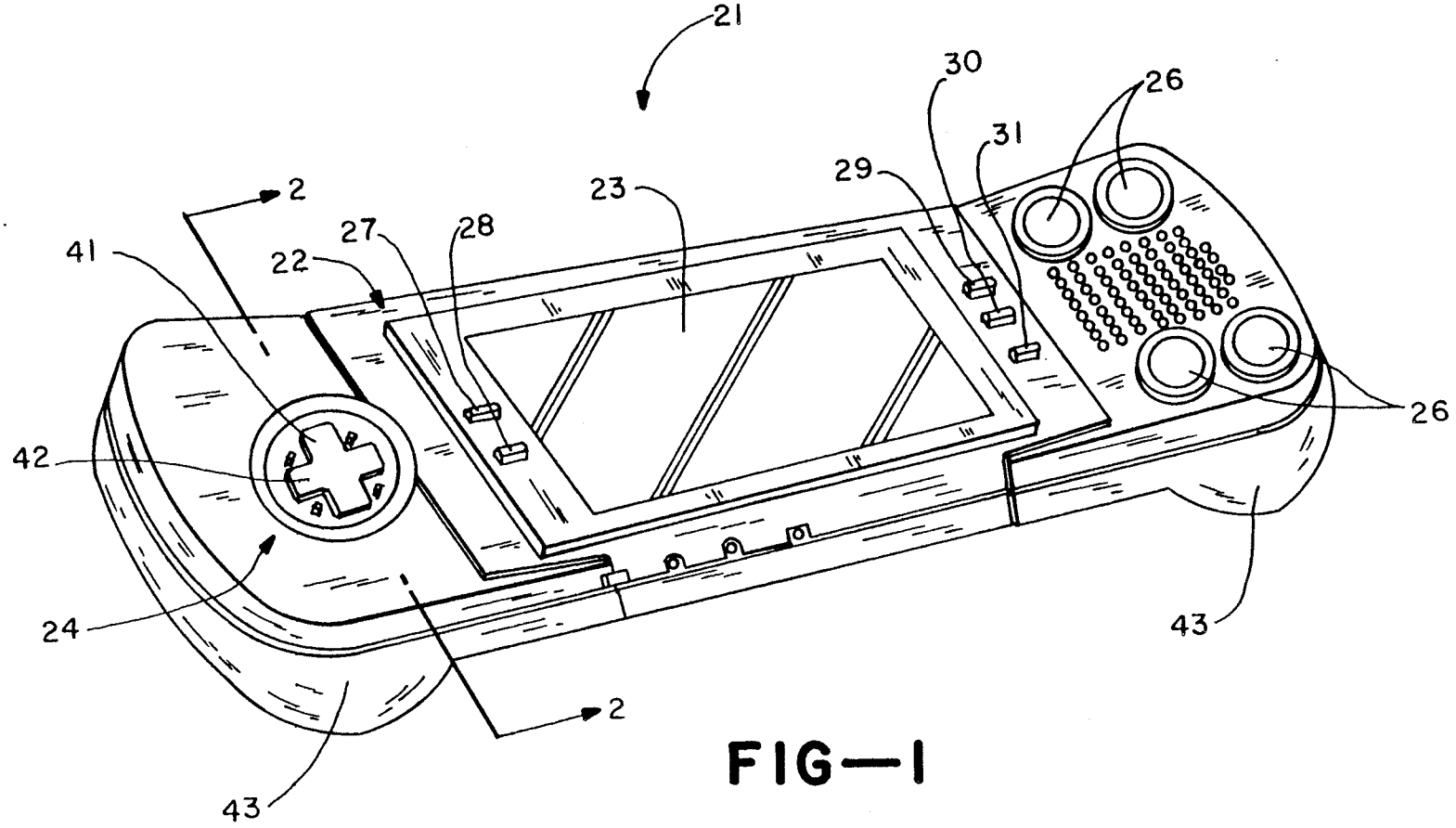
FIG. 1 is a top perspective view of an electronic game apparatus having a multi-directional switch assembly constructed in accordance with the present invention.

A hand-held electronic game apparatus, generally designated 21, can be seen in FIG. 1 to include an elongated housing, generally designated 22, in which a video display screen 23 is centrally mounted. On either side of screen 23 are a multi-directional switch assembly, generally designated 24, and fire buttons 26 which enable the game player to manipulate images on screen 23 for the play of various games. The game apparatus further includes an "on" button 27 and an "off" button 28, as well as switches 29, 30 and 31 which are, respectively, "invert," "pause" and "restart" switches or buttons Inside housing 22 is an electronic circuit assembly including a CPU and associated electronics for the display of images on screen 23 during play of the game. The construction and operation of the electronic game circuitry is not regarded as being a novel portion of the present invention and will not be described in detail herein.

As may be seen from FIG. 1, multi-directional switch assembly 24 preferably takes the form of a joypad switch assembly in which there is a generally disk-like input member or joypad 41 that is mounted in a generally horizontal orientation and has four radially extending arm members 42 which can be depressed by the thumb of the game player while gripping the housing ends, particularly back surface 43 of the housing, with the player's fingers.

As is conventional, joypad 41 includes four laterally extending arms 42 which can be used to manipulate the image on screen 23 in the up, down, right and left directions.

Figure 2:
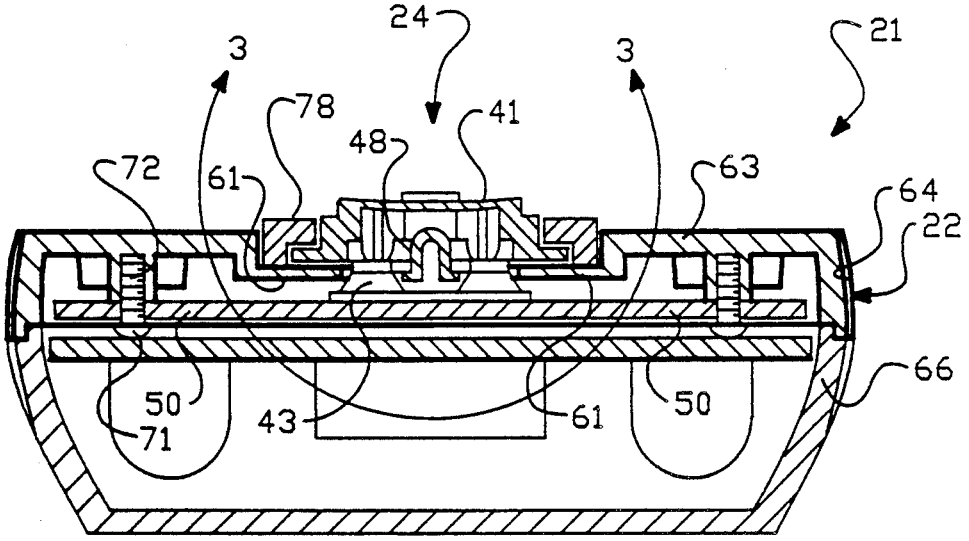
FIG. 2 is an end-elevation view, in cross-section of the game apparatus of FIG. 1 taken substantially along the plane of line 2—2 in FIG. 1.
Figure 3:
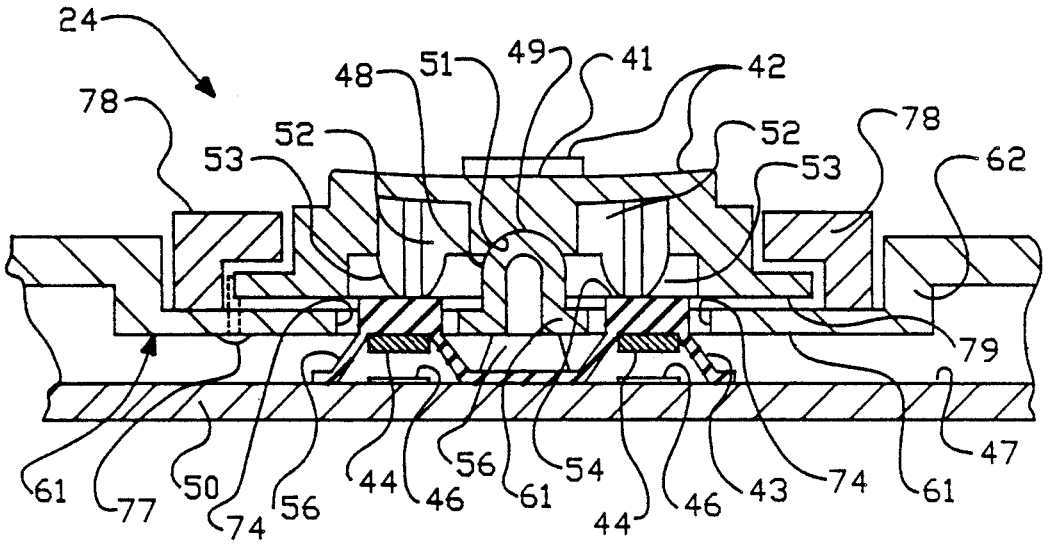
FIG. 3 is an enlarged, fragmentary, end elevation view of the area bounded by line 3—3 in FIG. 2.

The details of construction of the multi-directional switch assembly of the present invention can best be understood by reference to FIGS. 2 and 3. As will be seen, the disk-like input pad or joypad 41 is mounted in superimposed relation to a resilient deformable member 43, which carries a plurality of electrically conductive contact elements 44. The contact elements 44 are mounted proximate but in spaced relation to switch terminals 46 carried on an upper surface 47 of substrate, most preferably printed circuit board 50.

In order to enable joypad 41 to close the various switches on circuit board 47, a central support post means, generally designated 48, is positioned beneath joypad 41 and includes an upwardly facing spherical surface 49 which mates with a downwardly facing spherical surface 51 in joypad 41. As will be appreciated, post assembly 48 can also include a reversal of parts in which the spherical surface carried by joypad 41 is a downwardly projecting convex element that is received by a spherical socket 51 in post assembly 48.

Figure 6:
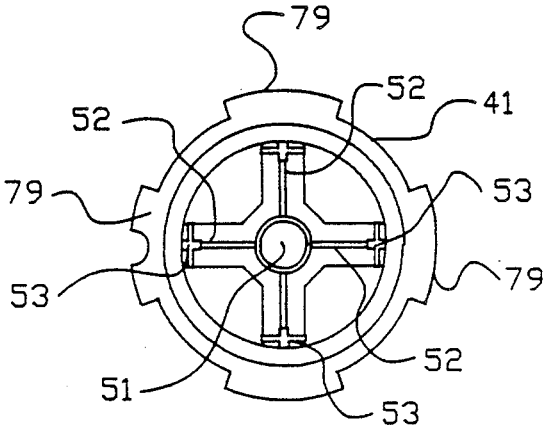
FIG. 6 is a bottom plan view of the input joypad of FIG. 5.

Universal central post assembly 48 provides the joypad with a mount which permits tilting of the pad about the central post to effect deformation of the resiliently deformable rubber member 43. This deformation can be accomplished through cruciform-shaped arms 52 which have arcuate protruding surfaces 53 that engage upper surface 54 of deformable rubber member 43. The construction of arms 52 also can be seen in FIG. 6.

As will be appreciated, therefore, when joypad member 41 is tilted about post means 48, the arcuate surfaces 53 engage and depress upper surface 54 of deformable member 43. This deformation causes collapsing of the conical portions 56 of member 43, with the result that a contact 44 is displaced against switch terminals 46 on the printed circuit board to close, or change the state, of the switch.

As thus far described, joypad assembly 24 is constructed in a manner well known in the prior art. In the improved multi-directional switch assembly of the present invention, the post assembly 48 is mounted in a manner which isolates the post assembly and thrust applied to joypad 41 from printed circuit board 50.

In the preferred embodiment of the present invention, isolation of the thrust forces applied to joypad 41 is provided by mounting joypad 41 to housing 22 via a frame 61 and mounting printed circuit board 50 in spaced relation to joypad 41 via frame 61 and support posts 48. This arrangement suspends printed circuit board 50 from frame 61 independent of housing 22, thus isolating it from the force transmitted from the joypad 41 to housing 22 through frame 61. Support posts 48 are constructed as a portion of frame 61. Frame 61 extends laterally from support posts 48 and then steps upwardly at shoulder 62 which is also constructed as a portion of frame 61. Frame 61 continues as upper lateral portion 63, until it reaches side walls 64, which are supported on bottom housing 66.

As will be seen from FIG. 2, therefore, the joypad member and post assembly 48 are effectively supported directly from the side walls of the housing. Printed circuit board 50 is supported by fasteners 71 from bosses 72 which extend downwardly from upper lateral portion 63. A downward thrust on joypad 41, however, is not directly transferred to the printed circuit board, since support post 48 is carried by the transversely extending frame 61, which extends completely to the side walls. The downward thrust, therefore, is resisted or supported by the side walls 64.

While printed circuit board 50 is supported from upper lateral portion 63, it is not centrally stressed in bending, as would be the case if post means 48 were supported directly on the printed circuit board. Instead, any bending of upper lateral portion 63 due to the downward thrust on joypad 41 merely causes the entire board assembly to be displaced downwardly, rather than inducing bending moments in the printed circuit board.

Figure 4:
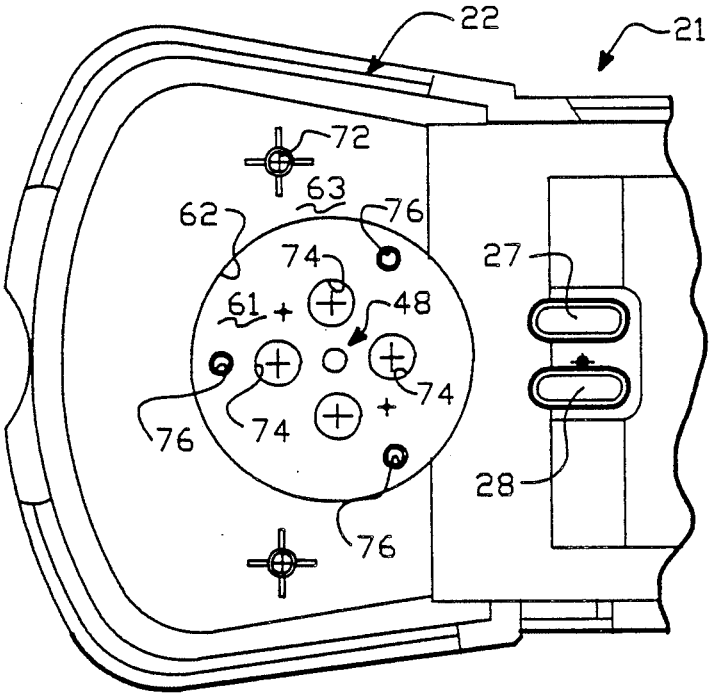
FIG. 4 is a fragmentary, enlarged, top plan view of an end of the electronic game apparatus of FIG. 1 with the joypad assembly removed.

In order to permit the transmission of motion from joypad 41 to the deformable rubber member 43, transversely extending frame 61, which supports post 48, is formed with a plurality of apertures or openings 74, which can be most clearly seen in FIG. 4.

Figure 5:
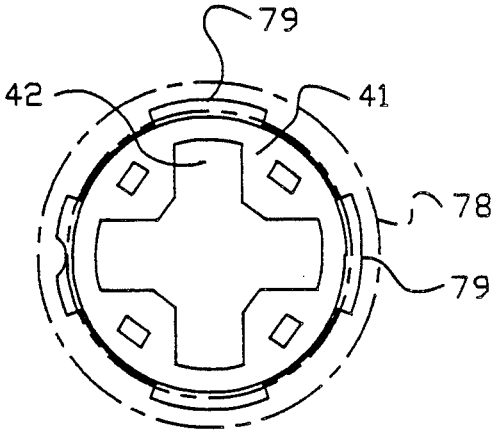
FIG. 5 is a top plan view of the joypad input element suitable for mounting to the housing of FIG. 4.

As also can be seen in FIG. 4, frame 61 preferably is formed with openings 76 which receive fasteners 77 (FIG. 3) that are used to secure a collar 78 to frame 61. The joypad mounting collar has an L-shaped cross section that holds the input pad 41 in place in the recess defined by shoulder 62 in the upper surface of housing 22. As best may be seen in FIG. 5, collar 78, shown in phantom, traps the laterally extending flanges 79 on joypad 41.

The mounting structure of the multi-directional switch assembly of the present invention affords a highly responsive and play-free switch which is nevertheless substantially isolated from or does not transmit substantial thrust force through to the printed circuit board. This allows the joypad assembly to withstand substantial thrust forces, while permitting rapid manipulation, which are common in electronic game apparatus.

What is claimed is:

1. In a multi-directional switch assembly including a printed circuit board having a plurality of switch terminals; a resilient deformable member having a plurality of electrically conductive contact elements carried thereby mounted proximate said printed circuit board with said contact elements superimposed with respect to and spaced apart from said switch terminals; a manually engageable input member mounted proximate said deformable member; and central support post means mounted under a central portion of said input member; said central support post means and said input member having mating support surfaces for tilting said input member thereabout for displacement of said deformable member by an amount sufficient to move said contact elements into engagement with said switch terminals, wherein the improvement in said switch assembly comprises:

frame means mounting said support post means independently of and in spaced relationship to said printed circuit board to substantially isolate said printed circuit board from forces manually applied to said input member.

2. The switch assembly as defined in claim 1 wherein, said deformable member is mounted to said printed circuit board; and said frame means supports forces manually applied to said input means beyond the force required to displace said deformable member and engage said terminals with said contact elements

3. The switch assembly as defined in claim 2 wherein, said input member is a manually engageable joypad.

4. The switch assembly as defined in claim 1 wherein, said frame means is a housing wall portion extending across and in spaced relation above said printed circuit board for support of forces independently thereof.

5. The switch assembly as defined in claim 1 wherein, said input member is a disk-like member mounted proximate a center thereof for tilting about said post means to effect displacement of said deformable member.

6. The switch assembly as defined in claim 5 wherein, said post means is carried by a transversely extending housing wall portion having a plurality of openings therein; and one of said input members and said deformable member extend through said openings to transmit displacement of input member to said deformable member.

7. The switch assembly as defined in claim 6 wherein, said deformable member is mounted directly to said printed circuit board.

8. The switch assembly as defined in claim 4 wherein, said switch assembly is mounted in a housing having side walls;

said housing wall portion extends to said side walls;

said printed circuit board is suspended downwardly from said housing wall portion at positions inside said side walls and on opposite sides of said central support post means.

9. A multi-directional switch assembly comprising:

a substrate;

a plurality of electrical switch terminals carried by said substrate;

a manually manipulatable input means;

a plurality of movable electrical contact members mounted so as to move into and out of engagement with the electrical switch terminals in response to movement of the manually manipulatable input means;

a housing for enclosing the substrate;

frame means for mounting said input means to said housing; and means for suspending said substrate from said input means in spaced relation independent of the housing for substantially isolating said substrate from forces applied to said input means.

10. A multi-directional switch assembly as in claim 9 wherein said means for mounting isolates said printed circuit board from said housing.

11. A multi-directional switch assembly comprising:

a printed circuit board having a plurality of switch terminals;

a housing for enclosing the printed circuit board;

a manually engageable input member mounted proximate said printed circuit board having a plurality of electrically conductive contact elements carried thereby with said contact elements superimposed with respect to and spaced apart from said switch terminals;

central support means mounted under a central portion of said input member;

said central support means and said input member having mating support surfaces for allowing said input member to tilt thereabout for displacement of said deformable member by an amount sufficient to move said contact elements into engagement with said switch terminals; deformable frame means for mounting said support post means to said housing; and means for mounting said printed circuit board to said support post means in spaced relation independent of said housing for substantially isolating said printed circuit board from forces applied to said input member.

12. A multi-directional switch assembly as in claim 11 further comprising a resilient deformable member mounted between said input member and said printed circuit board for biasing the contact elements away from engagement with said switch terminals.

* * * * *